United States Patent [19]

Wisotzki et al.

[11] Patent Number: 4,839,098

[45] Date of Patent: Jun. 13, 1989

[54] LIQUID DETERGENT

[75] Inventors: Klaus-Dieter Wisotzki, Erkrath; Ortburg Guirr, Krefeld; Peter Jeschke, Neuss; Klaus Schumann, Erkrath; Karl-Heinz Schmid, Mettmann; Manfred Biermann, Muehlheim/Ruhr, all of Fed. Rep. of Germany

[73] Assignee: Henkel Kommanditgesellschaft auf Aktien, Dusseldorf, Fed. Rep. of Germany

[21] Appl. No.: 157,681

[22] Filed: Feb. 18, 1988

[30] Foreign Application Priority Data

Feb. 25, 1987 [DE] Fed. Rep. of Germany ..... 3706015

[51] Int. Cl.[4] ..... C11D 1/12

[52] U.S. Cl. ..... 252/557; 252/174.17; 252/173; 252/153; 252/DIG. 14

[58] Field of Search ..... 252/174.17, 153, 173, 252/557, DIG. 14, 550

[56] References Cited

U.S. PATENT DOCUMENTS

| | | | |
|---|---|---|---|
| 2,941,050 | 6/1960 | Korpi et al. | 252/153 |
| 3,219,656 | 11/1965 | Boettner | 260/210 |
| 4,072,632 | 2/1978 | Reed | 252/541 |
| 4,434,087 | 2/1984 | Hampson et al. | 252/545 |
| 4,434,088 | 2/1984 | Billington et al. | 252/547 |
| 4,434,089 | 2/1984 | Billington et al. | 252/547 |
| 4,434,090 | 2/1984 | Hampson et al. | 252/547 |
| 4,538,128 | 7/1985 | Naik | 252/549 |
| 4,565,647 | 1/1986 | Lienado | 252/354 |
| 4,576,744 | 3/1986 | Edwards et al. | 252/554 |
| 4,599,188 | 7/1986 | Lienado | 252/174.17 |
| 4,732,704 | 3/1988 | Biermann et al. | 252/548 |
| 4,734,221 | 3/1988 | Edwards et al. | 252/548 |
| 4,734,223 | 3/1988 | Winterbotham | 252/548 |

FOREIGN PATENT DOCUMENTS 35340827 9/1985 Fed. Rep. of Germany .

*Primary Examiner*—Josephine Barr

*Attorney, Agent, or Firm*—Ernest G. Szoke; Wayne C. Jaeschke; Real J. Grandmaison

[57] ABSTRACT

A liquid manual dishwashing detergent composition consisting essentially of alkyl glucoside and dialkyl sulfosuccinate. The composition provides improved detergency and foam stability against proteinaceous soils.

11 Claims, No Drawings

LIQUID DETERGENT

BACKGROUND OF THE INVENTION

1. Field of the Invention

This invention relates to a liquid manual dishwashing detergent composition, and more particularly, to such a composition consisting essentially of an alkyl glucoside and a dialkyl sulfosuccinate. The composition provides longer lasting suds against proteinaceous soils.

Liquid detergents generally consist of aqueous solutions of synthetic anionic and/or nonionic surfactants and conventional additives. They are used in particular for cleaning hard surfaces, for example of glass, ceramic materials, plastics, painted and polished surfaces. One important application for liquid detergents is in the manual washing of eating and cooking utensils, i.e., dishwashing. Dishwashing is generally carried out in highly dilute solutions at slightly elevated temperatures of from about 35° to 45° C. The cleaning power of a detergent is normally judged by the user to be better the longer and the more richly the wash solution foams. Because of the prolonged contact between the hands and the washing solution in manual dishwashing, the compatibility of the detergent with the skin is another particularly important factor. For these reasons, the expert, in selecting the components and the composition of a manual dishwashing detergent, must take into account factors other than those governing the composition of liquid cleaning preparations for other hard surfaces.

It is generally known that alkyl ether sulfates, i.e. salts of sulfated adducts of from about 2 to 5 moles ethylene oxide with fatty alcohols containing approximately 10 to 18 and preferably 12 to 16 carbon atoms in the aliphatic portion, display high foaming and cleaning power and are also gentle to the skin. Accordingly, conventional commercially available manual dishwashing detergents are generally aqueous solutions of such alkyl ether sulfates in conjunction with other surfactants, more especially alkyl benzenesulfonates, and solubilizers, dyes and perfumes.

2. Discussion of Related Art:

U.S. Pat. No. 2,941,950 describes liquid detergents for manual dishwashing which contain a combination of an alkyl ether sulfate and a nonionic surfactant of the fatty acid alkanolamide type or mono- or dialkanolamides containing no more than 3 carbon atoms in each alkanol radical of saturated $C_{10}$–$C_{14}$ fatty acids together with water, solubilizers, dyes and perfumes.

It is also known from U.S. Pat. No. 3,219,656 that nonionic alkyl monoglucosides not only form stable foam themselves, but they also act as foam stabilizers for other anionic and nonionic surfactants.

U.S. Pat. Nos. 4,565,647 and 4,599,188 describe foaming liquid detergents containing anionic surfactants, alkyl glucosides and amine oxides or fatty acid alkanolamides, the alkyl glucosides being alkyl oligoglucosides which contain the glucose unit approximately 1.5 to 10 times. This value is an average unit and also takes into account the presence of alkyl monoglucosides in a corresponding proportion. Alkyl glucosides having a degree of oligomerization of greater than 2 have proved to be particularly suitable.

German patent application No. P 35 34 082.7 describes a manual dishwashing detergent containing synthetic anionic surfactants of the sulfonate and/or sulfate type, fatty acid alkanolamides and fatty alkyl glucosides, characterized in that it contains fatty alkyl glucosides of the fatty alkyl monoglucoside type containing on average less than 2 glucoside units and more especially from 1 to 1.4 glucoside units per fatty alkyl radical.

Detergents, more especially dishwashing detergents, containing di-n-alkyl sulfosuccinates have long been known. Thus, in particular, U.S. Pat. No. 4,072,632 describes liquid dishwashing detergents containing alkyl ether sulfates and sulfosuccinates, preferably di-n-octyl sulfosuccinates, and optionally other surfactants.

An aqueous mixture of alkyl sulfosuccinates and alkyl ether sulfates is also known from U.S. Pat. No. 4,576,744 which, in addition, describes aqueous solutions of alkyl sulfosuccinates alone and of alkyl sulfosuccinates in admixture with alkyl benzenesulfonates.

Various other patents, including inter alia, U.S. Pat. Nos. 4,434,087, 4,434,090, 4,434,088, 4,434,089 and 4,528,128 are concerned with the same disclosures, the chain lengths of the alkyl sulfosuccinate being changed, the consistency of the detergents improved or foam stability increased.

DESCRIPTION OF THE INVENTION

Other than in the operating examples, or where otherwise indicated, all numbers expressing quantities of ingredients or reaction conditions used herein are to be understood as modified in all instances by the term "about".

It has now surprisingly been found that the foaming and cleaning power of liquid, optionally aqueous, detergents which are specifically designed for manual dishwashing and which essentially contain an alkyl glucoside may be enhanced by adding to them a dialkyl sulfosuccinate containing from 7 to 9 and more especially 8 carbon atoms in the alkyl radical. The alkyl radical may be straight chained or branched. The proportion of dialkyl sulfosuccinate is from 20 to 90 parts by weight and preferably from 50 to 80 parts by weight, based on the total surfactant content of from 15 to 50% by weight in the product. They are present as alkali metal salts, more especially sodium salts.

Accordingly, the proportion of alkyl glucoside containing from 10 to 18 and preferably from 12 to 14 carbon atoms in the alkyl radical and from 1 to 5 and preferably from 1 to 1.4 glucose units (GU) in the molecule in the detergents according to the invention is from 10 to 80 parts by weight and preferably from 20 to 50 parts by weight, based on the total surfactant content of 15 to 50% by weight in the product.

If the afore-mentioned surfactants are partly replaced by an anionic surfactant, preferably an alkyl ether sulfate or alkyl sulfate, and amphoteric surfactant, such as acylamidopropyl dimethyl ammonium betaine for example, it is possible to obtain an improvement in performance in regard to dishwashing power and in storage stability.

The detergents according to the invention are preferably free from petrochemical-based anionic surfactants, such as alkyl benzenesulfonates and alkanesulfonates for example, which are normally used in dishwashing detergents.

Suitable solubilizers, for example for small additions of dyes and perfume oils, include for example alkanolamines, polyols such as ethylene glycol, 1,2-propylene glycol or glycerol, while suitable hydrotropes include alkali metal alkyl benzenesulfonates containing from 1 to 3 carbon atoms in the alkyl radical such as sodium cumenesulfonate. The quantities in which they are used are generally from 1 to 10% by weight, based on the weight of the detergent as a whole.

In addition, solvents, such as low molecular weight alkanols containing from 1 to 4 carbon atoms in the molecule, preferably ethanol and isopropyl alcohol, are generally used. The quantities in which they are used are again from 3 to 15% by weight, based on the weight of the detergent as a whole. Viscosity regulators, such as urea, sodium chloride, ammonium chloride, magnesium chloride and sodium citrate, may be used either individually or in combination with one another. Other standard optional additives include corrosion inhibitors, preservatives, dyes and perfume oils.

In every case, the balance to a total of 100% by weight, based on the weight of the detergent as a whole, consists of water.

The liquid detergents according to the invention illustrated in the following examples were obtained by stirring the individual constituents together and allowing the mixture to stand until it was free from bubbles. The sulfosuccinates used in the examples were the sodium salts.

EXAMPLE I

The saucer test is described in this example.

A quantity of 27 g di-isooctyl sulfosuccinate and 15 g isopropanol was stirred in 55 g water at room temperature. 3 g $C_{12}$–$C_{14}$ alkyl glucoside containing 1.1 glucose units (GU) in the molecule were then added with continued stirring. The product was a clear liquid and had a Hoeppler viscosity at 20° C. of 30 mPa.s. To test detergency, saucers were each coated with 2 g molten beef tallow (test soil) (A)). 8 l tapwater (16° Gh) at 50° C. were then introduced into a bowl. To wash the saucers soiled with test soil (A), 4 g, i.e. 0.5 g/l, of the prepared detergent were added and the saucers washed. 23 saucers could be washed clean before the foam of the initially high-foaming solution disappeared. When the alkyl glucoside was left out and the quantity of dialkyl sulfosuccinate increased to 30 g, only 6 saucers could be washed before the foam disappeared. When the dialkyl sulfosuccinate was left out and the quantity of alkyl glucoside increased to 30 g, 12 saucers could be washed clean before the foam disappeared (Table 1).

Table 1 shows the dishwashing power of mixtures of disooctyl sulfosuccinate and $C_{12}$–$C_{14}$ alkyl glucoside containing 1.1 GU. The comparison is with a standard dishwashing detergent based on dodecyl benzene sulfonate and $C_{12}$–$C_{14}$ alkyl ether sulfate containing 2 ethylene oxide groups in a ratio by weight of 70:30. 30% total active substances (AS) in the detergent. Soil: 2 g beef tallow/saucer Dishwashing solution: 0.5 g/l detergent, 50° C., 16° Gh.

TABLE 1

| Mixing ratio in parts by weight: Di-isooctyl sulfosuccinate | Alkyl glucoside | Saucer test soil (A) (beef tallow) Number of saucers washed clean | Performance in % compared with standard |
|---|---|---|---|
| 0 | 100 | 12 | 80 |
| 20 | 80 | 14 | 93 |
| 40 | 60 | 15 | 100 |
| 60 | 40 | 16 | 107 |
| 80 | 20 | 21 | 140 |
| 90 | 10 | 23 | 153 |
| 100 | 0 | 6 | 40 |
| Standard | | 15 | 100 |

EXAMPLE II

To test dishwashing performance, a mixed test soil (B) of protein, fat and carbohydrates (Henkel Mi No. 1) was used as well as the beef tallow test soil (A) disclosed in Example I. In accordance with Example I, 3 g di-isooctyl sulfosuccinate were replaced by 3 g $C_{12}$–$C_{14}$ alkyl sulfate for the same proportion of $C_{12}$–$C_{14}$ alkyl glucoside containing 1.1 GU. In the case of test soil (A), the number of saucers washed clean before the foam disappeared could thus be increased from 23 to 29. In the case of test soil (B), an increase in performance from 22 to 25 saucers was obtained. Table 2 shows that the three-component combinations also show a broader performance spectrum than the two-component combinations against various soils. Depending on the mixing ratio of the three individual surfactants, the performance of the standard dishwashing detergent containing alkyl benzenesulfonate and fatty alcohol ether sulfate in regard to difficult test soil (A) could be almost doubled without any increase in the total active substance content without suffering losses in the case of mixed soil (B) or exceeded by about 50% in the case of both soil types (Table 2).

TABLE 2

Dishwashing power of mixtures of di-isooctyl sulfosuccinate, alkyl glucoside and alkyl sulfate in comparison with standard dishwashing detergent based on alkyl benzenesulfonate and alkyl ether sulfate, 70:30.

30% total AS in the product; soil: 2 g beef tallow test soil (A)/saucer, or 2 g Mi No. 1 test soil (B)/saucer

| Mixing ratio in parts by weight: Di-isooctyl sulfosuccinate | Alkyl glucoside (GU 1.1) | $C_{12}$–$C_{14}$ alkyl sulfate | Saucer test soil (A) (0.5 g/l product 50° C., 16° Gh) Number of saucers washed clean | Performance in % compared with standard | Saucer test soil (B) (0.5 g/l product 45° C., 16° Gh) number of saucers washed clean | Performance in % compared with standard |
|---|---|---|---|---|---|---|
| 100 | — | — | 6 | 40 | 6 | 24 |
| 90 | 10 | — | 23 | 153 | 22 | 88 |
| 80 | 20 | — | 21 | 140 | 33 | 132 |
| 80 | 10 | 10 | 29 | 193 | 25 | 100 |
| 60 | 20 | 20 | 23 | 153 | 37 | 148 |
| Standard | | | 15 | 100 | 25 | 100 |

EXAMPLE III

Testing of the cloud or clear points reveals another advantage of the three-component surfactant combinations.

After storage for 24 hours at 0° C., a solution of 10 g $C_{12}$–$C_{14}$ alkyl glucoside (GU 1.4), 15 g di-isooctyl sulfosuccinate and 15 g ethanol in 60 g water became cloudy and, after freezing to −15° C. and then thawing, had a clear point of +12° C. However, when 5 g of the sulfosuccinate were replaced by 5 g $C_{12}$–$C_{14}$ alkyl ether sulfate containing 2 ethylene oxide groups, this solution remained clear on storage at 0° C. and, after freezing to −15° C. and then thawing, became clear again at +2° C. (Table 3). The compositions employed in the storage tests are shown in Table 3.

TABLE 3

| Composition | %/wt | %/wt |
|---|---|---|
| Diisooctyl sulfosuccinate | 15 | 10 |
| $C_{12}$–$C_{14}$ alkyl glucoside, GU 1.4 | 10 | 10 |
| $C_{12}$–$C_{14}$ alkyl ether sulfate containing 2 ethylene oxide groups | — | 5 |
| Ethanol | 15 | 15 |
| Water | 60 | 60 |
| Hoeppler viscosity at 20° C. | 15 mPa.s | 20 mPa.s |
| Storage at 0° C. | cloudy | clear |
| Cloud point | +9° C. | −1° C. |
| Clear point (thawed clearly after freezing at −15° C.) | +12° C. | +2° C. |

EXAMPLE IV

A solution of 10 g di-isooctyl sulfosuccinate, 4 g $C_{12}$–$C_{14}$ alkyl glucoside (GU 1.4), 6 g $C_{12}$–$C_{14}$ alkyl ether sulfate containing two ethylene oxide groups, 10 g isopropanol and 70 g water was used in the saucer test in accordance with Example I (0.6 g detergent/dishwashing solution). 27 of the saucers soiled with test soil (B) were washed clean before the foam disappeared. However, when 2 g of the alkyl ether sulfate were replaced by 2 g $C_8$–$C_{18}$ acylamidopropyl dimethyl ammonium betaine (Dehyton K ®), 30 plates were washed clean before the foam disappeared.

10 g sulfosuccinate, 6 g alkyl glucoside (GU 1.4), 4 g alkyl ether sulfate, 10 g isopropanol and 70 g water were completely mixed. In the saucer test, 28 of the saucers soiled with test soil (B) were washed clean before the foam disappeared. However, when 1 g of the alkyl glucoside was replaced by 1 g Dehyton K ®, 30 saucers were washed clean before the foam disappeared. The compositions employed in these tests are shown in Table 4.

TABLE 4

| 20% total surfactant, 2 g mixed test soil (B) per saucer | | | | |
|---|---|---|---|---|
| Composition | 1 | 2 | 3 | 4 |
| Di-isooctyl sulfosuccinate | 10 | 10 | 10 | 10 |
| $C_{12}$–$C_{14}$ alkyl glucoside (GU 1.4) | 4 | 4 | 6 | 5 |
| $C_{12}$–$C_{14}$ alkyl ether sulfate containing 2 ethylene oxide groups | 6 | 4 | 4 | 4 |
| Betaine (Dehyton K ®) | — | 2 | — | 1 |
| Isopropanol | 10 | 10 | 10 | 10 |
| Water | 70 | 70 | 70 | 70 |
| Saucer test soil (B) 0.6 g product/l water 45° C./16° Gh Number of plates washed clean before foam disappeared | 27 | 30 | 28 | 30 |

EXAMPLE V

This example caried out in accordance with Example I shows that, irrespective of the soil, alkyl monoglucosides in systems containing alkyl sulfosuccinates also show advantages over alkyl oligoglucosides in terms of dishwashing power, as already demonstrated with the systems alkyl glucoside/alkyl sulfate or alkyl ether sulfate and/or fatty acid alkanolamide (German application P 35 34 082).

TABLE 5

Shown herein is the influence of the glucose content in alkyl glucosides on the dishwashing power of mixtures of di-isooctyl sulfosuccinate and $C_{12}$–$C_{14}$ alkyl glucoside containing 1.1 to 2.2 glucose units.
30% total AS, 0.5 g product/l water.

| Mixing ratio | | | Saucer test soil (A) (50° C./16° Gh) number of saucers washed clean | Saucer test soil (B) (45° C./16° Gh) number of saucer washed clean |
|---|---|---|---|---|
| Di-isooctyl Sulfo-succinate | Alkyl glucoside (GU 1.1) | Alkyl glucoside (GU 2.2) | | |
| 40 | 60 | — | 15 | 46 |
| 40 | — | 60 | 11 | 40 |
| 60 | 40 | — | 16 | 42 |
| 60 | — | 40 | 10 | 38 |
| 80 | 20 | — | 21 | 33 |
| 80 | — | 20 | 15 | 29 |

EXAMPLE VI

As in Example I, the washing ability of surfactant mixtures of $C_{12}$–$C_{14}$ alkylglucoside and di-n-octyl-sulfosuccinate was tested. The results thereof are summarized in Table 6.

TABLE 6

| Mixing ratio in parts by weight | | Saucer test soil (A) (beef tallow) | Performance in % |
|---|---|---|---|
| di-n-octyl sulfo-succinate | alkyl glucoside GU 1.1 | number of saucers washed clean | compared with standard |
| 0 | 100 | 12 | 80 |
| 20 | 80 | 17 | 113 |
| 40 | 60 | 19 | 127 |
| 60 | 40 | 19 | 127 |
| 80 | 20 | 24 | 160 |
| 100 | 0 | 23 | 153 |
| standard | | 15 | 100 |

EXAMPLE VII

This experimental series, tested as in Example I, shows the effect of the degree of oligomerization of the $C_{12}$–$C_{14}$-alkyl glucoside on the washing performance in the combination with di-n-octylsulfosuccinate. The decrease in the washing performance with increasing degree of oligomerization of the alkylglucoside in the case of the mixed test soil (B) should be noted.

TABLE 7

| Mixing ratio in parts by weight | | Saucer test (number of saucers washed clean) | | | |
|---|---|---|---|---|---|
| | | (beef tallow test soil (A)) | | (MiNO 1 test soil (B)) | |
| di-n-octyl sulfo-succinate | alkyl glucoside | GU 2.2 | GU 4.0 | GU 2.2 | GU 4.0 |
| 0 | 100 | 11 | 7 | 35 | 19 |
| 20 | 80 | 18 | 11 | 42 | 23 |
| 40 | 60 | 22 | 17 | 40 | 28 |
| 60 | 40 | 26 | 22 | 40 | 28 |
| 80 | 20 | 27 | 24 | 33 | 27 |
| 100 | 0 | 24 | 24 | 24 | 24 |
| standard | | 15 | | 25 | |

We claim:

1. A liquid, manual dishwashing detergent composition containing from about 15 to about 50% by weight of a surfactant mixture, based on the weight of said composition, said surfactant mixture consisting essentially of an alkyl glucoside containing from about 10 to about 18 carbon atoms in the alkyl radical and from about 1 to about 1.4 glucose units in the molecules, and a dialkyl sulfosuccinate containing from about 7 to about 9 carbon atoms in the alkyl radical.

2. A detergent composition as in claim 1 wherein said dialkyl sulfosuccinate is present as an alkali metal salt.

3. A detergent composition as in claim 2 wherein said alkyl radical is straight chain or branched.

4. A detergent composition as in claim 1 wherein said alkyl glucoside is present in a quantity of from about 10 to about 80 parts by weight, and said dialkyl sulfosuccinate is present in a quantity of from about 20 to about 90 parts by weight, all weights being based on the total surfactant content of said detergent composition.

5. A detergent composition as in claim 1 wherein said alkyl glucoside is present in a quantity of from about 20 to about 50 parts by weight, and said dialkyl sulfosuccinate is present in a quantity of from about 50 to about 80 parts by weight, all weights being based on the total surfactant content of said detergent composition.

6. A liquid, manual dishwashing detergent composition containing from about 15 to about 50% by weight of a surfactant mixture, based on the weight of said composition, said surfactant mixture consisting essentially of an alkyl glucoside containing from about 10 to about 18 carbon atoms in the alkyl radical and from about 1 to about 1.4 glucose units in the molecule, and a dialkyl sulfosuccinate containing from about 7 to about 9 carbon atoms in the alkyl radical, said alkyl glucoside being present in a quantity of from about 10 to about 80 parts by weight, and said dialkyl sulfosuccinate being present in a quantity of from about 20 to about 90 parts by weight, all weights being based on the total surfactant content of said detergent composition.

7. A detergent composition as in claim 6 wherein said dialkyl sulfosuccinate is present as an alkali metal salt.

8. A detergent composition as in claim 7 wherein said alkyl radical is straight chain or branched.

9. A liquid, manual dishwashing detergent composition containing from about 15 to about 50% by weight of a surfactant mixture, based on the weight of said composition, said surfactant mixture consisting essentially of an alkyl glucoside containing from about 10 to about 18 carbon atoms in the alkyl radical and from about 1 to about 1.4 glucose units in the molecule, and a dialkyl sulfosuccinate containing from about 7 to about 9 carbon atoms in the alkyl radical, said alkyl glucoside being present in a quantity of from about 20 to about 50 parts by weight, and said dialkyl sulfosuccinate being present in a quantity of from about 50 to about 80 parts by weight, all weights being based on the total surfactant content of said detergent composition.

10. A detergent composition as in claim 9 wherein said dialkyl sulfosuccinate is present as an alkali metal salt.

11. A detergent composition as in claim 10 wherein said alkyl radical is straight chain or branched.

* * * * *